US006128393A

United States Patent [19]

Kondo

[11] Patent Number: 6,128,393

[45] Date of Patent: Oct. 3, 2000

[54] MICROPHONE WITH SHOCK-RESISTANT MEANS

[75] Inventor: Kazuhisa Kondo, Yamato, Japan

[73] Assignee: Kabushiki Kaisha Audio-Technica, Tokyo, Japan

[21] Appl. No.: 09/204,027

[22] Filed: Dec. 1, 1998

[30] Foreign Application Priority Data

Feb. 27, 1998 [JP] Japan ..... 10-064715

[51] Int. Cl.[7] ..... H04R 9/08

[52] U.S. Cl. ..... 381/368; 381/355; 381/361

[58] Field of Search ..... 381/355–363, 381/368, 179, 91

[56] References Cited

U.S. PATENT DOCUMENTS

| | | | |
|---|---|---|---|
| 3,944,756 | 3/1976 | Lininger | 381/355 |
| 3,989,905 | 11/1976 | Anderson et al. | 381/368 |
| 4,401,859 | 8/1983 | Watson | 381/355 |
| 4,694,499 | 9/1987 | Bartlett | 381/357 |
| 5,706,359 | 1/1998 | Chang | 381/357 |
| 5,818,946 | 10/1998 | Walter | 381/312 |
| 5,859,916 | 1/1999 | Ball et al. | 381/326 |
| 5,988,585 | 11/1999 | Eaton | 381/91 |
| 6,041,131 | 3/2000 | Kirchhofer et al. | 381/415 |

*Primary Examiner*—Paul Loomis
*Assistant Examiner*—Rexford Barnie
*Attorney, Agent, or Firm*—Welsh & Katz, Ltd.

[57] ABSTRACT

A microphone in which stopper means are provided between the mike grip side and the microphone unit assembly side. The stopper means maintain the non-contact state with each other when the microphone receives no shock, and come in contact with each other, when the microphone receives shock, with the movement of the microphone unit assembly in the axial direction of the mike grip caused by the shock to prevent the further movement of the microphone unit assembly.

18 Claims, 2 Drawing Sheets

MICROPHONE WITH SHOCK-RESISTANT MEANS

FIELD OF THE INVENTION

The present invention relates to a microphone of a shock mount system having a microphone unit supported through elastic support means, and more specifically to a microphone with shock-resistant means for protecting the microphone unit from falling shock or the like.

BACKGROUND OF THE INVENTION

A hand-mike is normally provided with a cylindrically formed mike grip, on the extreme end side of which is mounted a microphone unit. Further, on the extreme end side of the mike grip is mounted a head case formed, for example, from a wire net for covering the microphone unit.

In the hand mike as described above, there often occurs hand grip noises due to the rubbing of fingers relative to the mike grip. To cope with this, there is employed a system in which a microphone unit is mounted on a mike grip through an elastic member.

For example, Japanese Utility Model Application Laid-Open No. 5-41291 discloses the employment of a shock mount system in which a microphone unit is mounted on a mike grip through an elastic member within a protective tube formed of a rubber material.

However, normally, a microphone cord is connected to the rear end of the mike grip, and it is therefore said to be preferable to design such that the extreme end side (fore side) of the microphone is heavy in consideration of balance therebetween.

Accordingly, in the event that the microphone is erroneously fallen, the extreme end side tends to impinge upon the floor surface. In such a case, a great shock force is applied in an axial direction of the mike grip to the microphone. Because of this, a microphone unit assembly subjected to floating by the shock mount is sometimes fallen off from the shock mount to be damaged or wiring is broken. Even in the event that the assembly is not fallen off, it is sometime damaged due to the collision against the head case caused by excessive movement of the microphone unit assembly.

For preventing troubles as described above, there are three methods as noted below:

a) Method for using a soft wire for the head case to absorb the falling shock;

b) method for increasing the rigidity of the microphone unit itself; and c) method for selecting stocks such as a mike grip to lighten the weight of the microphone.

However, even if these methods are used, there involved the following problems:

a) The head case itself is easily deformed due to the falling shock;

b) the microphone unit assembly is still fallen off from the shock mount, and in the extreme case, the wiring becomes broken; and c) in this case, it is necessary to look over again the entire constitution including the designing idea. For example, if the shock mount is removed, and the microphone unit is directly secured to the mike grip, it is possible to prevent the microphone unit from being fallen off. However, this sacrifices the hand grip noise resistant effect.

SUMMARY OF THE INVENTION

It is an object of the present invention to provide a microphone capable of preventing the falling off of a microphone unit assembly caused by the falling shock without impairing the handling noise resistant effect caused by the shock mount.

The microphone according to the present invention comprises a mike grip, a microphone unit assembly mounted on the extreme end side of said mike grip through elastic support means, and stopper means provided between said microphone grip side and said microphone unit assembly side, said stopper means preventing, when the microphone receives the shock, the movement of said microphone unit assembly more than as needed caused by the shock.

According to this constitution, since the stopper means is held in a non-contact state when in normal use, the handling noise resistant effect caused by the elastic support means (shock mount) is not impaired.

On the other hand, when the microphone unit assembly moves in a falling off direction upon receipt of the falling shock, the stopper means is actuated to prevent further movement of the microphone unit assembly, that is, the falling off thereof from the elastic support means.

In the present invention, the stopper means will suffice to be simple which comprises a first projection provided on the mike grip side, and a second projection provided on the microphone unit assembly side. According to this, the stopper means can be applied to the existing shock mount without requiring a considerable change in design.

Further, preferably, the elastic support means comprises a support tube fitted on the extreme end side of the mike grip, and a pair of elastic members provided on the both sides of the support tube and coaxially holding the microphone unit assembly with respect to the support tube in each central portion thereof, and the stopper means is provided between the support tube and the microphone unit assembly.

In this case, said one elastic member is provided with a projection which is projected into the support tube to constitute said one stopper means, and the support tube side is bored with a fitting hole through which said projection is inserted, whereby said projection and said fitting hole can be used as connecting means for connecting said one elastic member and said support tube.

Accordingly, in the present invention, it is possible to prevent the falling off of the microphone unit assembly caused by the falling shock without considerably changing the constitution of the microphone and without impairing the handling noise resistant effect caused by the shock mount.

DESCRIPTION OF THE PREFERRED EMBODIMENT

The embodiments of the present invention will now be explained with reference to the drawings.

Figure 1:
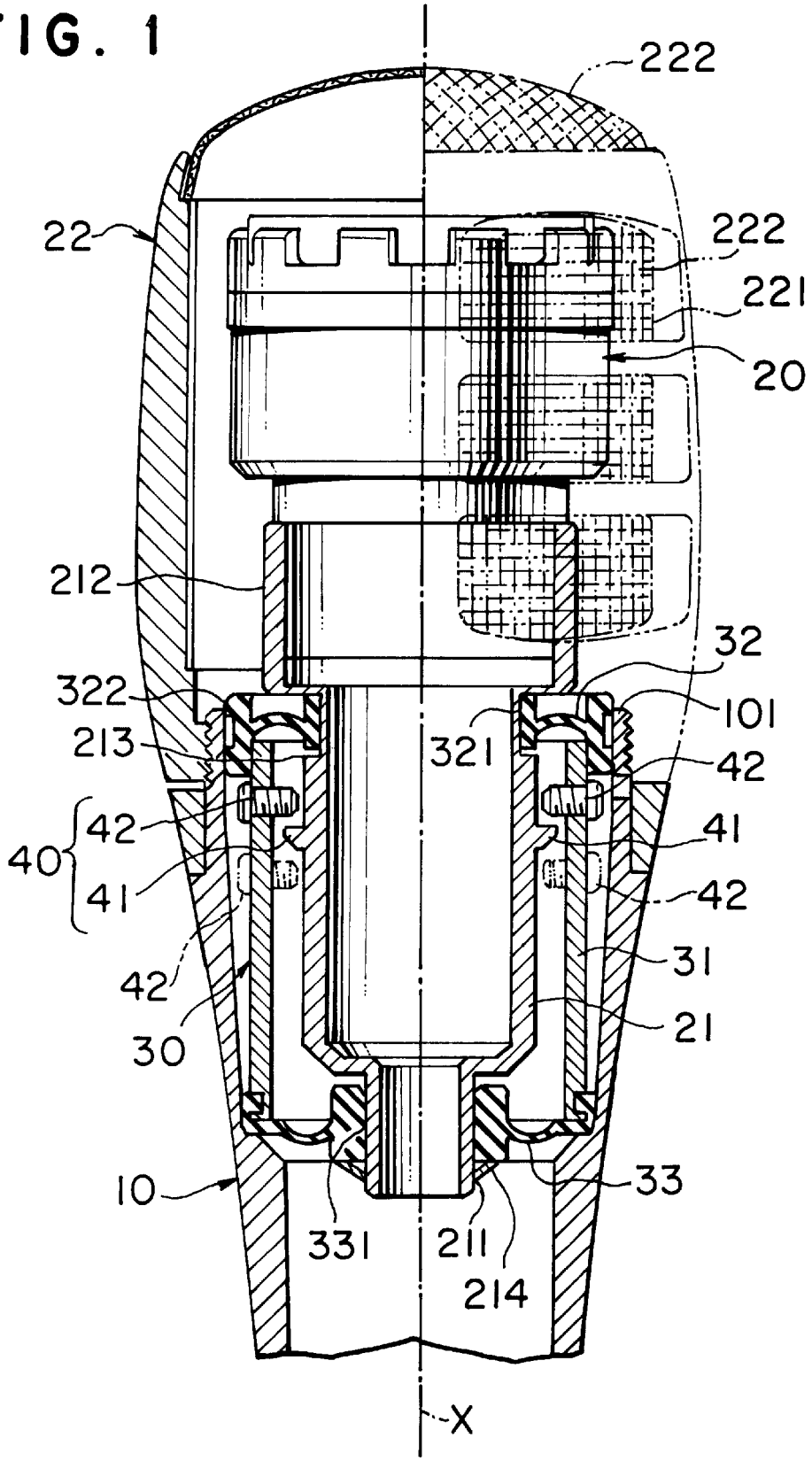
FIG. 1 is a sectional view of the main part showing a first embodiment of a microphone provided with shock resistant means according to the present invention.

Referring to FIG. 1, a first embodiment of the present invention will be explained. According to the first embodiment, the microphone is provided with a cylindrical mike grip 10 formed of, for example, a zinc alloy or the like, and a microphone unit 20 (a microphone unit assembly) is mounted on the extreme end side through a shock mount 30 as elastic support means.

The microphone unit 20 is roughly divided into a dynamic type and a condenser type. The microphone unit 20 in this embodiment is of the dynamic type. A cylindrical cup 21 extending into the mike grip 10 is mounted on the rear end portion of the microphone unit. This cup 21 is used as a weight to lower the resonant frequency.

The cup 21 is formed at its upper part with a large-diameter unit receiver 212 for fitting and holding the microphone unit 20. The cup 21 is formed at its lower end with a small-diameter axial tube 211, from which a wiring not shown is drawn into the mike grip 10.

Ahead case 22 for covering the microphone unit 20 is provided on the extreme end side of the mike grip 10. The head case 22 is provided with windows 221 formed with a regularity in consideration of designing effect as shown by the chain line in right-half of FIG. 1, each window 221 having a wire net 222 stretched thereover.

The shock mount 30 is provided with a cylindrical support tube 31 fitted into the extreme end of the grip 10. The support tube 31 is formed of, for example, metal, the inside diameter of which is larger than the outside diameter of the cup 21 of the microphone unit 20.

Elastic members 32 and 33 are mounted on both ends of the support tube 31. In the present embodiment, the elastic members 32 and 33 are formed of disk-like rubber. They are bored with holding holes 321 and 331 coaxially with respect to the axis X of the mike grip 10.

In this case, the holding hole 321 of the upper elastic member 32 positioned above in FIG. 1 is somewhat smaller in diameter than a fitting groove 213 formed above the cup 21. Further, the holding hole 331 of the lower elastic member 33 positioned below is also somewhat smaller in diameter than the axial tube 211 of the cup 21.

Accordingly, in the microphone unit 20, the cup 21 is forcibly inserted from one holding hole 321 side whereby in the direction of axis X of the mike grip 10 the former is firmly held within the holding holes 321 and 331 of the elastic members 32 and 33. It is noted that in this embodiment, a stop washer 214 is mounted on the axial tube 211.

The elastic member 32 is formed in its peripheral edge with a flange 322 elastically deformed and fitted into an upper end opening 101 of the mike grip 10. The shock mount 30 is secured, at the flange 322 portion, to the mike grip 10 by means of a screw not shown. In this case, the flange 322 can be also secured to the mike grip 10 by means of an adhesive.

In this manner, the microphone unit 20 (microphone unit assembly) is mounted on the mike grip 10 through the shock mount 30, and between the microphone unit 20 (microphone unit assembly) and the mike grip 10 is provided stopper means 40 for preventing the microphone unit 20 (microphone unit assembly) from moving moderately more than as needed in the direction of axis X due to the falling shock or the like.

In this embodiment, the stopper means 40 comprises a rib (a second projection) 41 formed annularly along the outer periphery of the cup 21 of the microphone unit 20 and a screw (a first projection) 42 provided on the support tube 31 side so as to come in contact with the rib 41.

In this case, the screw 42 is arranged at a position closer to the extreme end of the mike grip 10 as viewed from the rib 41 to prevent the microphone unit 20 (microphone unit assembly) from falling off (coming out) from the shock mount 30. The spacing between the rib 41 and the screw 42 is suitably determined, for example, from a relationship with the axial length of the cup 21 and so on. It is noted that the screw 42 is screwed into the support tube 31 after the microphone unit 20 (microphone unit assembly) has been mounted on the shock mount 30.

According to this constitution, even if the microphone should fall off on the floor surface from the extreme end side of the head case 22, due to the shock of which the microphone unit 20 (microphone unit assembly) would move in the direction of axis X of the mike grip 10, the microphone unit 20 (microphone unit assembly) is prevented from further movement because the rib 41 comes in contact with the screw 42.

In the event that the microphone falls off from the rear end side, the microphone unit 20 (microphone unit assembly) is to be moved into the mike grip 10. However, to prevent the excessive movement, the screw 42 can be arranged at the rear position of the rib 41 (see the position indicated by the chain line in FIG. 1).

While in this embodiment, the rib 41 is formed integral with the cup 21, it is to be noted that an annular ring can be fitted into the cup 21. Alternatively, a plurality of the screws 42 can be arranged at equal intervals on one and the same circumference. As the case may be, the single screw will suffice. Further, a boss-like projection in place of a screw may be employed.

Conversely to the aforementioned embodiment, a rib is annularly formed on the inner peripheral surface side of the support tube 31, and a projection in contact therewith may be provided on the cup 21 side. Alternatively, the rib is not to be annular but only at a portion where a projection of the mating party is positioned, a rib can be formed so as to oppose thereto.

Figure 2:
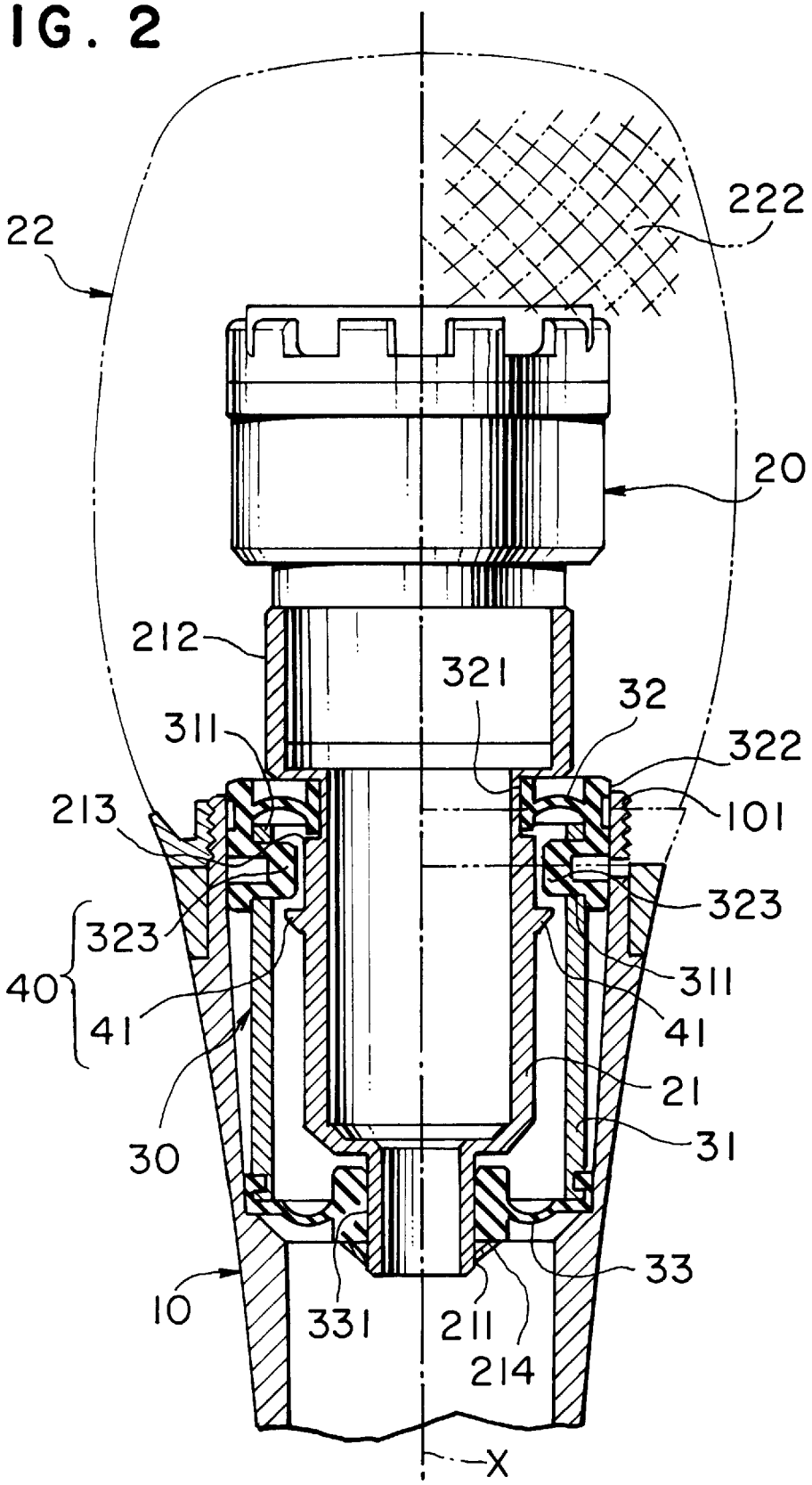
FIG. 2 is a sectional view of the main part showing a second embodiment of a microphone provided with shock resistant means according to the present invention.

FIG. 2 shows a second embodiment which has further developed over the first embodiment. In this second embodiment, the projection provided on the support tube 31 side comprises a rubber projection 323 formed integral with the elastic member 32. That is, on the lower end side of the inner peripheral surface of the flange 322 of the elastic member 32 is provided the rubber projection 323 projected into the support tube 31 so that the rubber projection 323 may come into contact with the rib 41. Preferably, a plurality of the rubber projections 323 are provided at equal intervals. The support tube 31 are bored with fitting holes 311 through which the rubber projections 323 are inserted.

In mounting the microphone unit 20 (microphone unit assembly) on the shock mount 30, in the second embodiment, the upper elastic member 32 is first mounted on the cup 21 side, and the axial tube 211 of the cup 21 is fitted into the holding hole 331 of the lower elastic member 33. The upper elastic member 32 is mounted over the upper end of the support tube 31, and the rubber projections 323 are inserted through the fitting holes 311.

With this, the rubber projections 323 are projected into the support tube 31 to serve as stoppers relative to the rib 41, and the upper elastic member 32 and the support tube 31 are firmly connected by the rubber projections 323. In this sense, the rubber projections 323 serve as connecting means of both the upper elastic member 32 and the support tube 31.

The respective embodiments have been explained. The support tube 31 of the shock mount 30 is a constituent member on the mike grip 10 side. Accordingly, the provision of one projection of the stopper means on the support tube 31 means the same as that said projection is provided on the mike grip 10 side.

Further, the cup 21 of the microphone unit 20 constitutes a part of the microphone unit 20 as the microphone unit assembly. Accordingly, the provision of the other projection of the stopper means on the cup 21 means the same as that said projection is provided on the microphone unit 20 side.

What is claimed is:

1. A microphone comprising:

a mike grip;

an elastic support mounted on the extreme end side of said mike grip;

a microphone unit assembly mounted through said elastic support; and a stopper provided between said microphone grip side and said microphone unit assembly side, said stopper preventing, when the microphone receives a shock, the movement of said microphone unit assembly more than as needed caused by the shock, said stopper comprising a first projection provided on the mike grip side, and a second projection provided on said microphone unit, in which said projections, when said microphone receives no shock, maintain a non-contact state with each other, while when said microphone receives said shock, come in contact with each other, with the movement of said microphone unit assembly in the axial direction of said mike grip caused by said shock.

2. A microphone having a microphone unit assembly, a mount for said microphone unit assembly, a casing for containing said mount, the casing having a grip portion, a head casing connected with an end of said mount for covering said microphone unit assembly, and an elastic member fitted between said mount and said casing, said microphone unit comprising;

a first tube contained in the grip portion of said casing;

a second tube having a first cylindrical portion for containing said microphone unit assembly, a second cylindrical portion which is of smaller diameter than that of said first cylindrical portion, and a third cylindrical portion which is of smaller diameter than that of the second cylindrical portion, the second tube being contained in said first tube;

a first elastic member disposed between said casing at a top end thereof and the second cylindrical portion of said second tube;

second elastic member disposed between said casing, and the third cylindrical portion of said second tube;

said first and second elastic member permitting limited movement of said microphone unit along said central axis; and a first stop which comprises a first rigid projection provided about the periphery of the second cylindrical of said second tube, and a second rigid projection internally provided to said first tube, the first and second projections being spaced apart in normal state, whereas the first projection is brought into contact with the second projection during said movement thereby limiting said movement.

3. The microphone according to claim 2, wherein said microphone unit assembly contained in said second tube, is utilized as a weight for lowering resonance frequency.

4. The microphone according to claim 2, wherein said microphone further comprises a plurality of third projections formed inside of said casing at the top end thereof; a stepped portion formed about the periphery of said second tube at a position where is spaced downward from the second projection of said first tube; a gap formed between said casing and said first tube; and said first and second elastic member formed in the shape of a ring, of which said first elastic member has a first opening coaxially about said center with the axis, the stepped portion of said second tube being fitted in the first opening, a first flange portion at the stepped portion of said second tube, the first flange being formed on its internal edge, a second flange portion fitted in said gap, a ring portion which is of a domed section, formed between said first and second flange portions, and a plurality of apertures in said second flange portion, in which respective projections provided to said first tube are fitted thereby the first elastic member connected with said casing, and of which second elastic member has a second opening coaxially provided thereto with respect to said central axis, said third cylinder portion being fitted in the second opening, a first flange portion formed on an inner edge thereof, and a second flange portion formed on an outer edge thereof.

5. The microphone according to claim 4, wherein the opening of said first elastic member is of slightly smaller diameter than that of said stepped portion, and wherein the opening of said second elastic member is of slightly smaller than that of said third tube portion.

6. The microphone according to claim 4, wherein the first flange portion of said second elastic member is held by a second stop disposed about the periphery of said third tube portion.

7. The microphone according to claim 2, wherein said first stop comprises a rib formed about a periphery of said second cylindrical portion, as said first projection; and at least one or more first projecting elements disposed, as said second projection, at a position slightly spaced downward from the top end of said first tube and thereby protruded inside of an inner surface of said first tube.

8. The microphone according to claim 7, wherein said microphone further comprises at least one or more second projecting elements which are inserted into an aperture provided to the periphery of said first tube at a position spaced downward from the rib of said second tube.

9. The microphone according to claims 7 or 8, wherein either or both of said second and third projecting elements comprise a nut.

10. The microphone according to claim 2, wherein said first stop further comprises a ring mounted on the periphery of said second cylindrical portion, as said first projection; and at least one or more said second projections disposed, as said second projection, at a position slightly spaced downward from the top end of said first tube and thereby inside of said first tube.

11. The microphone according to claim 10, wherein said microphone further comprises at least one or more third projections which are inserted into an aperture provided to the periphery of said first tube at a position spaced downward from the rib of said second tube.

12. The microphone according to claim 10, wherein either or both of said second and third projections comprises nuts.

13. The microphone according to claim 2, wherein said first stop comprises a first rib formed about the periphery of said second tube, as said first projection; and a second rib formed inside of said first tube, as said second projection.

14. The microphone according to claim 13, wherein either of said first and second rib comprises a plurality of projecting elements.

15. A microphone having a microphone unit assembly, a tubular member in which said microphone unit assembly is mounted, a casing for containing said tubular member, the casing having a grip portion, a head casing connected with the top end of said casing for covering said microphone unit assembly, and an elastic member fitted between an outer surface of said tubular member and an inner surface of said casing; said microphone unit comprising:

said casing having a plurality of projections formed inside thereof, a first tube contained in the grip portion of said casing, a second tube having a first cylindrical portion for containing said microphone unit assembly, the first cylindrical portion having at least one or more first apertures formed at a position slightly spaced downward from its top end, a stepped portion formed about the periphery thereof, and a first projection formed about the periphery thereof, a second cylindrical portion which is of smaller diameter than that of said first cylindrical portion, and a third cylindrical portion which is of smaller diameter than that of the second cylindrical portion of said second tube, the second tube being contained in said first tube;

a gap formed between said casing and said first tube;

a first elastic member disposed between said casing at the top end thereof and the second cylindrical portion of said second tube, the first elastic member being formed in the shape of a ring, having a first opening coaxially provided thereto with respect to a central axis, the stepped portion of said second tube being fitted in the first opening, a first flange portion at a position where the stepped portion of said second tube is positioned, the first flange being formed along its internal edge, a second flange portion fitted in said gap, a ring portion which is of a domed section, formed between said first and second flanges, a plurality of apertures provided to said second flange portion, in which respective projections provided to said first tube are fitted thereby the first elastic member is connected with said casing, and a plurality of second projections formed at proximal end thereof, second projections being inserted into respective apertures formed at a position where is slightly spaced downward from a top end of said first tube, to be protruded inside of said first tube, second elastic member disposed between said casing and said second tube, the second elastic member having a second opening coaxially provided thereto with respect to said central axis, said third cylinder portion being fitted in the second opening, a first flange portion formed along the internal edge thereof, a second flange portion formed along the external edge thereof, and a ring portion which is of a domed section, formed between said first and second flange portions;

said first and second elastic member permitting limited movement along the central axis; and a first stop which comprises a first projection provided about the periphery of the second cylindrical portion of said second tube, and a second projection internally provided to said first tube, the first and second projections being spaced apart in normal state, whereas the first projection is brought into contact with the second projection, during said movement along the central axis to limit said movement.

16. The microphone according to claim 15, wherein said microphone unit assembly contained in said second tube, is utilized as a weight for lowering resonance frequency.

17. The microphone according to claim 15, wherein the opening of said first elastic member is of slightly smaller diameter than that of said stepped portion, and wherein the opening of said second elastic member is of slightly smaller than that of said third cylindrical portion.

18. The microphone according to claim 15, wherein the first flange portion of said second elastic member is held by second stop disposed about a periphery of said third cylindrical portion.

* * * * *